US007972447B2

(12) United States Patent
Nagel et al.

(10) Patent No.: US 7,972,447 B2
(45) Date of Patent: Jul. 5, 2011

(54) SCREENING ARRANGEMENT FOR A DISHWASHER, AND ASSOCIATED APPARATUS AND METHOD

(75) Inventors: Douglas J. Nagel, Waterloo, IA (US); Gregory A. Meyer, Batesville, IN (US); John C. Bragg, Evansville, IN (US)

(73) Assignee: Electrolux Home Products, Inc., Cleveland, OH (US)

( * ) Notice: Subject to any disclaimer, the term of this patent is extended or adjusted under 35 U.S.C. 154(b) by 0 days.

(21) Appl. No.: 12/108,048

(22) Filed: Apr. 23, 2008

(65) Prior Publication Data

US 2008/0283094 A1 Nov. 20, 2008

Related U.S. Application Data

(60) Provisional application No. 60/938,027, filed on May 15, 2007.

(51) Int. Cl.
*A47L 15/42* (2006.01)
*A47L 15/14* (2006.01)

(52) U.S. Cl. ..... 134/10; 134/56 D; 134/57 D; 134/58 D; 134/105; 210/348; 210/356

(58) Field of Classification Search ..... 134/56 D, 134/57 D, 58 D, 105, 10; 210/48, 354, 356, 210/471
See application file for complete search history.

(56) References Cited

U.S. PATENT DOCUMENTS

| | | | | |
|---|---|---|---|---|
| 2,750,950 | A | 6/1956 | Inman et al. | |
| 3,289,683 | A | 12/1966 | Tomlin | |
| 3,502,090 | A | 3/1970 | Grunewald | |
| 3,555,242 | A | 1/1971 | Jenkins et al. | |
| 3,915,180 | A * | 10/1975 | Jacobs | 134/58 D |
| 4,096,872 | A * | 6/1978 | Herbst et al. | 134/105 |
| 4,279,384 | A | 7/1981 | Yamamoto | |
| 4,366,005 | A | 12/1982 | Oguri et al. | |
| 4,416,300 | A * | 11/1983 | Jordan | 134/108 |
| 5,097,855 | A | 3/1992 | Martinsson et al. | |
| 5,165,433 | A | 11/1992 | Meyers | |
| 5,630,437 | A | 5/1997 | Dries et al. | |
| 5,743,281 | A | 4/1998 | Sargeant et al. | |
| 5,810,035 | A * | 9/1998 | Tekriwal et al. | 134/105 |
| 5,816,273 | A | 10/1998 | Milocco et al. | |
| 2004/0159339 | A1 * | 8/2004 | Elick et al. | 134/25.2 |
| 2005/0211277 | A1 | 9/2005 | Fransson | |
| 2006/0042668 | A1 | 3/2006 | Welch | |
| 2006/0174924 | A1 | 8/2006 | Hedstrom et al. | |

FOREIGN PATENT DOCUMENTS

| | | |
|---|---|---|
| DE | 198 58 137 A1 | 6/2000 |
| GB | 1 474 271 | 5/1977 |

* cited by examiner

*Primary Examiner* — Joseph L Perrin
*Assistant Examiner* — Benjamin Osterhout
(74) *Attorney, Agent, or Firm* — Alston & Bird LLP

(57) ABSTRACT

A screening arrangement is provided for a dishwasher having a tub portion defining a sump about a lower end thereof. The dishwasher further includes a heating element disposed proximate to the lower end of the tub portion and defining laterally-opposed inner and outer peripheries. A screen element is arranged adjacent the sump and is configured to screen a dishwashing fluid entering the sump from the tub portion. The screen element extends laterally inward of the inner periphery of the heating element and laterally outward of the outer periphery of the heating element. The screen element is also configured to be heat-resistant so as to protect one of the lower end, the sump, and a lower spray arm from heat emitted by the heating element. An associated apparatus and method are also provided.

16 Claims, 5 Drawing Sheets

SCREENING ARRANGEMENT FOR A DISHWASHER, AND ASSOCIATED APPARATUS AND METHOD

CROSS-REFERENCE TO RELATED APPLICATION

This application claims the benefit of the filing date of U.S. Provisional Patent Application Ser. No. 60/938,027 filed May 15, 2007, the entire disclosure of which is hereby incorporated herein by reference.

BACKGROUND OF THE INVENTION

1. Field of the Invention

Embodiments of the present invention relate to washing appliances and, more particularly, to a screening arrangement for a washing appliance, and an apparatus and method associated therewith.

2. Description of Related Art

A typical dishwasher includes a tub that forms an enclosure for receiving kitchenware to be washed, and one or more spray arms mounted in the interior of the tub and connected to a pump for spraying water under pressure onto the kitchenware. Such a dishwasher generally includes a lower rack for holding larger items such as dinner plates, pots, pans, and the like, and an upper rack for holding glassware, smaller bowls, and the like. The tub has a bottom wall or lower end that defines a sump into which the water flows after it has been sprayed onto the kitchenware. Particles dislodged from the kitchenware are carried along with the water toward the sump. Typically, a filtering system may be provided for screening and/or filtering the particles so that the water supplied by the pump to the spray arms is substantially devoid of particles, or at least substantially devoid of larger particles. A typical dishwasher often includes an internal heating element beneath the lower rack, which is often in the form of a rod-type resistance heating element formed into a loop that is mounted adjacent and spaced above the bottom wall of the tub.

As dishwashers continue to improve in washing effectiveness, quietness, and energy efficiency, more and more consumers are using dishwashers for a greater and greater percentage of their total dishwashing needs. Consequently, there is an ongoing impetus to increase the capacity of dishwashers without increasing their overall external size. One approach that may be considered in this regard is to move the lower rack down closer to the bottom wall of the tub, which thereby creates additional vertical space between the lower rack and the upper rack. However, this in turn would require moving the heating element closer to the bottom wall as well as the sump and its components (e.g., sump seal, mastic glue, etc.). The problem with this approach is that these materials and components can be damaged by exposure to the increased temperature that would result from lowering the heating element.

Thus, there exist a need for an apparatus and method for a dishwasher for protecting various portions and/or components of the dishwasher from heat emitted by such a heating element.

BRIEF SUMMARY OF THE INVENTION

The above and other needs are met by the present invention which, according to one aspect, provides a screening arrangement for a dishwasher having a tub portion defining a sump about a lower end thereof, wherein the dishwasher further includes a lower spray arm mounted adjacent to and above the lower end of the tub portion. A heating element is disposed proximate to the lower end of the tub portion and defines laterally-opposed inner and outer peripheries. A screen element is arranged adjacent the sump and is configured to screen dishwashing fluid entering the sump from the tub portion. The screen element extends laterally inward of the inner periphery of the heating element and laterally outward of the outer periphery of the heating element. The screen element is further configured to be heat-resistant so as to protect at least one of the lower end of the tub portion, the sump, and the lower spray arm from heat emitted by the heating element.

Another aspect provides a dishwasher comprising a tub portion defining a sump about a lower end thereof, wherein the dishwasher further comprises a lower spray arm mounted adjacent to and above the lower end of the tub portion. A heating element is disposed proximate to the lower end of the tub portion and defines laterally-opposed inner and outer peripheries. The dishwasher further comprises a screen element arranged adjacent the sump and configured to screen dishwashing fluid entering the sump from the tub portion. The screen element extends laterally inward of the inner periphery of the heating element and laterally outward of the outer periphery of the heating element. The screen element is further configured to be heat-resistant so as to protect at least one of the lower end of the tub portion, the sump, and the lower spray arm from heat emitted by the heating element.

Yet another aspect provides a method of protecting components of a dishwasher from heat emitted by a heating element associated therewith, wherein such a dishwasher includes a tub portion defining a sump about a lower end thereof. The dishwasher further includes a lower spray arm mounted adjacent to and above the lower end of the tub portion, wherein the heating element is disposed proximate to the lower end of the tub portion and defines laterally-opposed inner and outer peripheries. Accordingly, such a method comprises operably engaging a screen element about a lower end of the tub portion adjacent the sump. The screen element is configured to screen dishwashing fluid entering the sump from the tub portion and to be heat-resistant, such that the screen element extends laterally inward of the inner periphery of the heating element and laterally outward of the outer periphery of the heating element so as to protect at least one of the lower end of the tub portion, the sump, and the lower spray arm from heat emitted by the heating element.

Aspects of the present invention thus provide significant advantages as otherwise detailed herein.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE DRAWINGS

The present disclosure now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
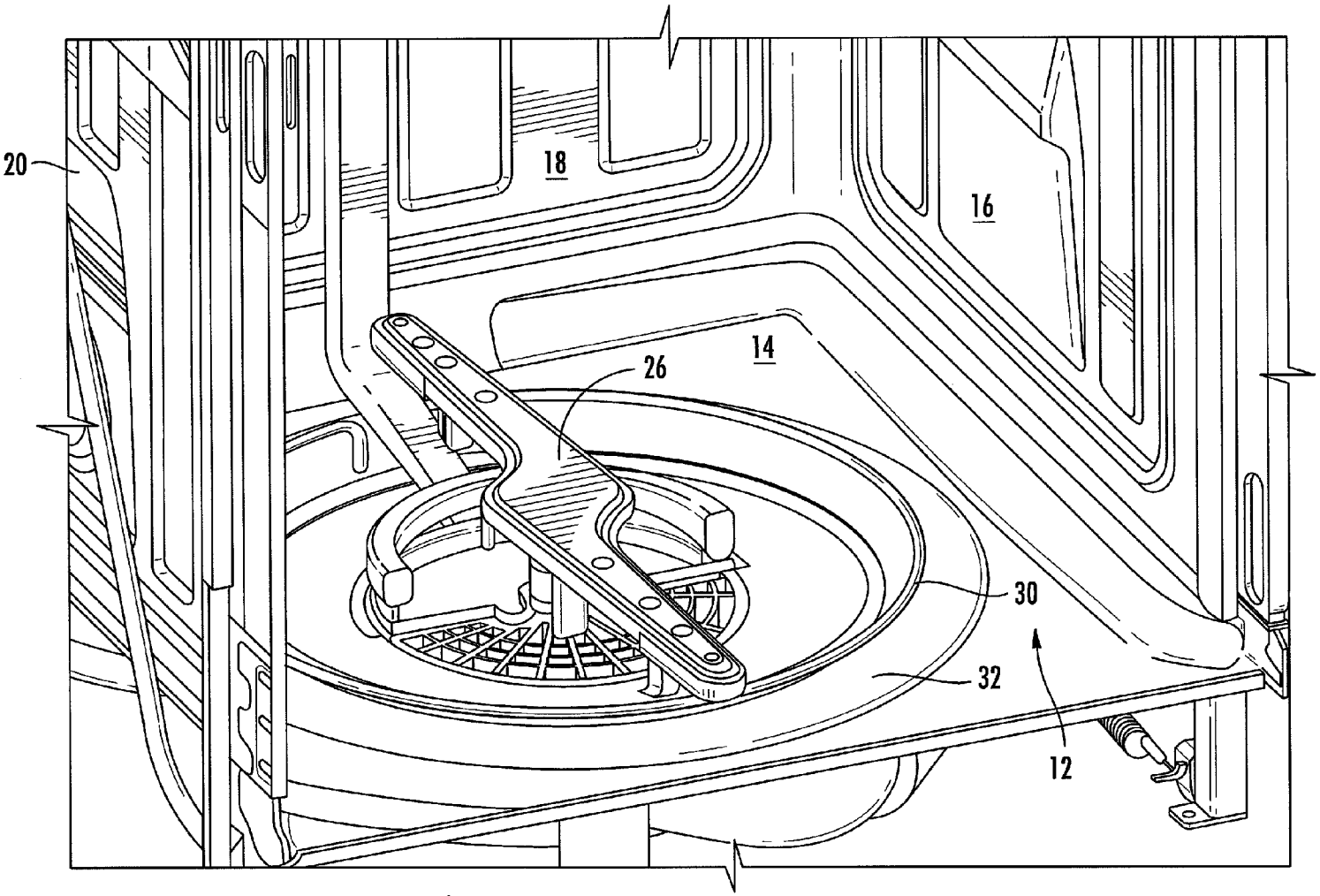
FIG. 1 is a fragmentary perspective view of a dishwasher according to one embodiment of the present disclosure, wherein a screen element is disposed beneath a heating element of the dishwasher for protecting a lower end and sump of the dishwasher from heat emitted by the heating element.
Figure 2:
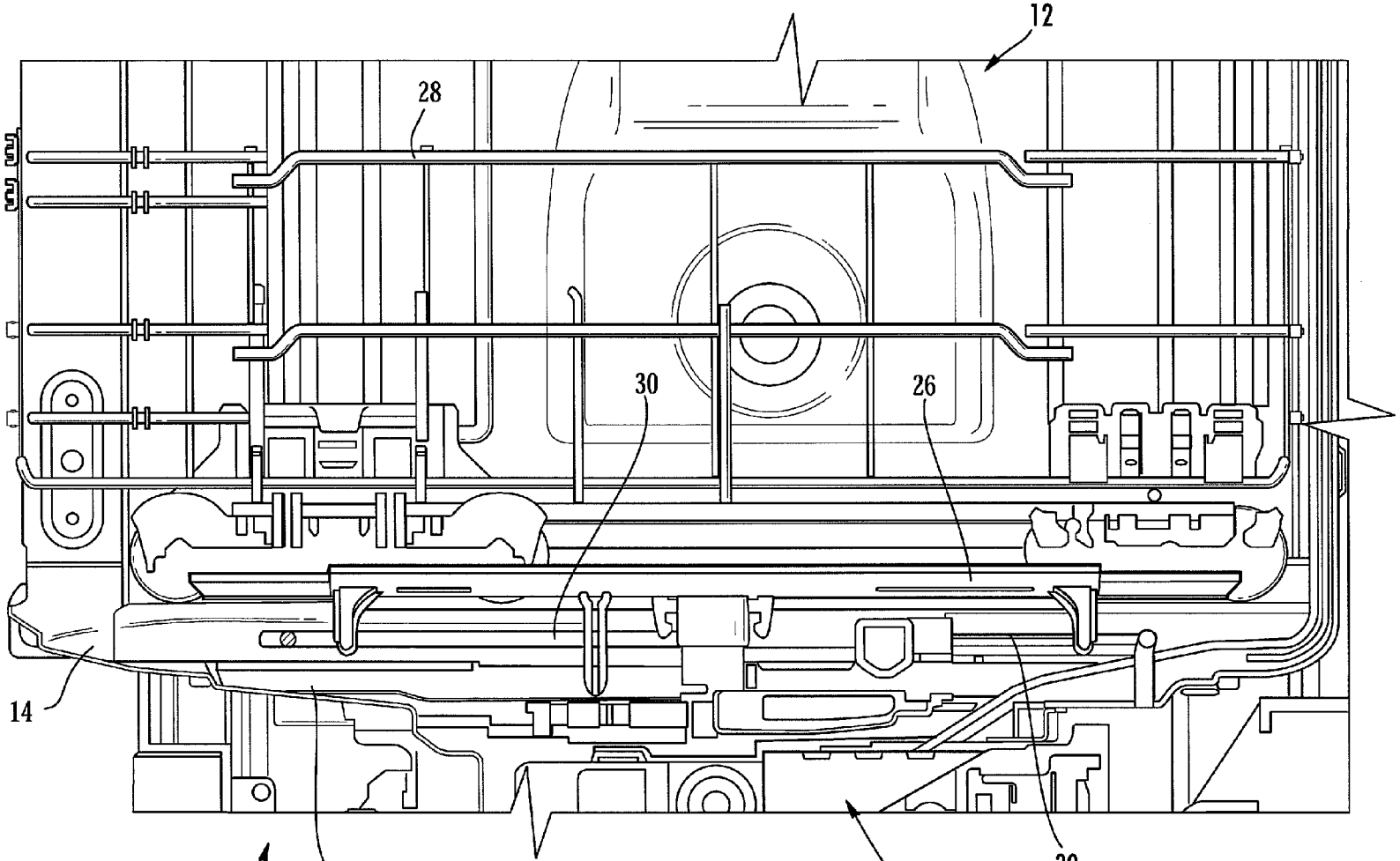
FIG. 2 is a vertical cross-sectional view of the dishwasher of FIG. 1, according to one embodiment of the present disclosure.

A dishwasher 10 in accordance with one embodiment of the invention is shown in FIGS. 1 and 2. The dishwasher includes a tub 12 that forms an enclosure. The tub 12 comprises a lower end (e.g., bottom wall 14) and a plurality of side walls 16, 18, 20 extending upwardly from the outer edge of the bottom wall 14. The tub 12 also includes a door (not shown) that forms all or part of a front wall of the tub, as well as a top wall (not shown), as understood by those skilled in the art. A sump 22 is connected to the bottom wall 14 to collect water and/or dishwashing fluid after it has been sprayed onto kitchenware disposed in the dishwasher 10. A pump 24 is arranged for pumping the water from the sump 22 to one or more spray arms, such as a lower spray arm 26, mounted in the interior of the tub 12. The illustrated lower spray arm 26 may be located proximate to the bottom wall 14 of the tub 12. Typically, there may also be an upper spray arm (not shown) mounted to the underside of the top wall of the tub 12, and in many cases there may be a mid-level spray arm (not shown) as well. The dishwasher 10 further may include a lower rack 28 (FIG. 2) located proximate to the bottom wall 14 for holding kitchenware to be washed. Typically, there may also be an upper rack (not shown) spaced above the lower rack. The racks are mounted to be able to slide in and out of the dishwasher 10 when the door is open (i.e., permitting access to the interior of the tub 12) to facilitate loading and unloading kitchenware from the dishwasher 10.

The dishwasher 10 may also include a heating element 30 spaced a distance above the lower end/bottom wall 14 of the tub. The heating element 30 may comprise a rod-type electrical resistance element (e.g., a rod element) shaped into a generally arcuate loop and fixedly mounted in suitable fashion. In some embodiments, the heating element 30 may define a radially outer periphery and a radially inner periphery.

In accordance with the present invention, the dishwasher 10 may further comprise a screen element (i.e., a filter 32) disposed adjacent the lower end/bottom wall 14 and arranged so as to screen/filter particles from the water flowing into the sump 22. For example, the filter 32 may be configured to screen coarse particles from the water flowing into the sump 22. In some embodiments, the filter 32 may be disposed between the heating element 30 and the lower end/bottom wall 14 and sump 22.

In addition to screening the water and/or dishwashing fluid, the filter 32 may also be configured to shield or otherwise protect the lower end/bottom wall 14 and the sump/sump components (e.g., the sump seal, air circulation fan, etc.) from heat emitted by the heating element 30. In this regard, the filter 32 may comprise a material configured to be heat-resistant and capable of withstanding the elevated temperatures caused by, for example, heat emitted by the heating element 30. A heat-resistant material is, for example, a material having suitable melting/deformation resistive properties such that the material is capable of withstanding certain elevated temperatures, without melting or otherwise deforming. To that end, the heat-resistant material of the filter 32 is capable of withstanding, without damage, at least the maximum temperature/heat emitted by the heating element 30 regardless of the distance between the heating element and the heat-resistant material, including embodiments where the heat-resistant material may be in contact with the heating element. Such a heat-resistant material should also be configured to prevent the heat experienced thereby from being transmitted or otherwise passed on to other proximal components of the dishwasher that may be susceptible to damage from the same temperatures experienced by the filter 32.

As an example, the filter 32 may be formed at least in part of a metal/metallic material such as stainless steel, or other suitable heat-insulating material, heat-reflecting material, heat-absorbing material, and/or heat-dissipating material, as will be appreciated by one skilled in the art. Other suitable materials may also be implemented such as, for example, composite materials, ceramic materials, polymer materials, and/or any other suitable materials or combinations thereof. For instance, the filter 32 may comprise a sheet of stainless steel perforated so as to define a multitude of holes of a predetermined diameter. As a non-limiting example, the filter 32 may comprise a stainless steel sheet having a thickness of about 0.010 inch to 0.015 inch, having holes of about 0.020 inch diameter, with about 20 percent open area. Alternatively, the filter 32 may comprise any other suitable thermal barrier material(s) and may have any other suitable construction for protecting adjacent components and materials from heat emitted by the heating element 30. For instance, a composite filter formed of stainless steel and overmolded with plastic may be employed in order to reduce the usage of stainless steel. In some instances, the material forming the filter 32 may be coated with, for example, a reflective coating for reflecting heat away from the filter 32 so as to make the filter 32 heat-resistant, wherein that the material comprising the filter 32 may not itself be heat-resistant. In other embodiments, a reflective coating may not be provided to coat the material forming the filter 32, wherein the material comprising the filter 32 may itself be heat-resistant, as described previously.

The filter 32 may be configured and appropriately arranged/positioned in order to protect the lower end/bottom wall 14 from the heat emitted by the heating element 30. Accordingly, the filter 32 may be structured and arranged such that the filter 32 extends a sufficient distance radially outwardly beyond the outer periphery of the heating element loop, as well as a sufficient distance radially inwardly beyond the inner periphery of the heating element loop, in order to cover a suitable area subject to the heat emitted by the heating element 30.

The radial extent of the filter 32 may also be dictated in part by considerations related to its screening/filtering function. Thus, for example, it may be desired to configure the filter 32 to have a predetermined size in terms of surface area. Accordingly, taking into account both the screening/filtering function and the heat-protection function to be performed, the filter 32 may be sized and positioned relative to the heating element 30 to achieve both objectives. Because the filter 32 not only screens/filters particles but also protects/shields the lower end/bottom wall 14 and/or lower spray arm 26 from the heating element 30, it is possible to move the lower spray arm 26, the heating element 30, and the bottom wall 14 closer together (i.e., to reduce the vertical spacing between them) while reducing the risk of heat damage to the bottom wall 14. This, in turn, makes it possible to move the lower rack 28 down closer to the bottom wall 14.

Figure 3:
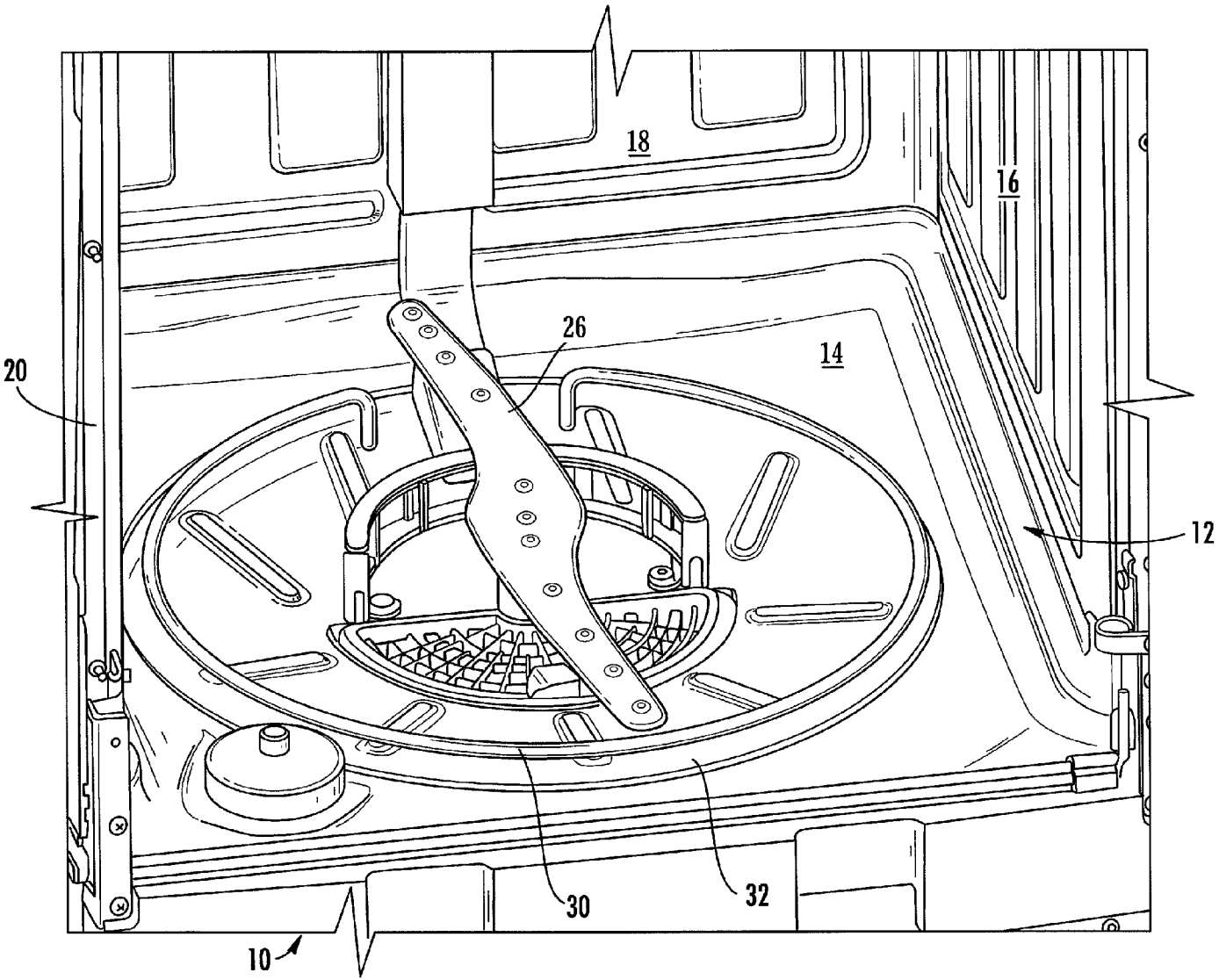
FIG. 3 is a fragmentary perspective view of a dishwasher according to another embodiment of the present disclosure, wherein a screen element is disposed beneath a heating element of the dishwasher for protecting a lower end and sump of the dishwasher from heat emitted by the heating element.
Figure 4:
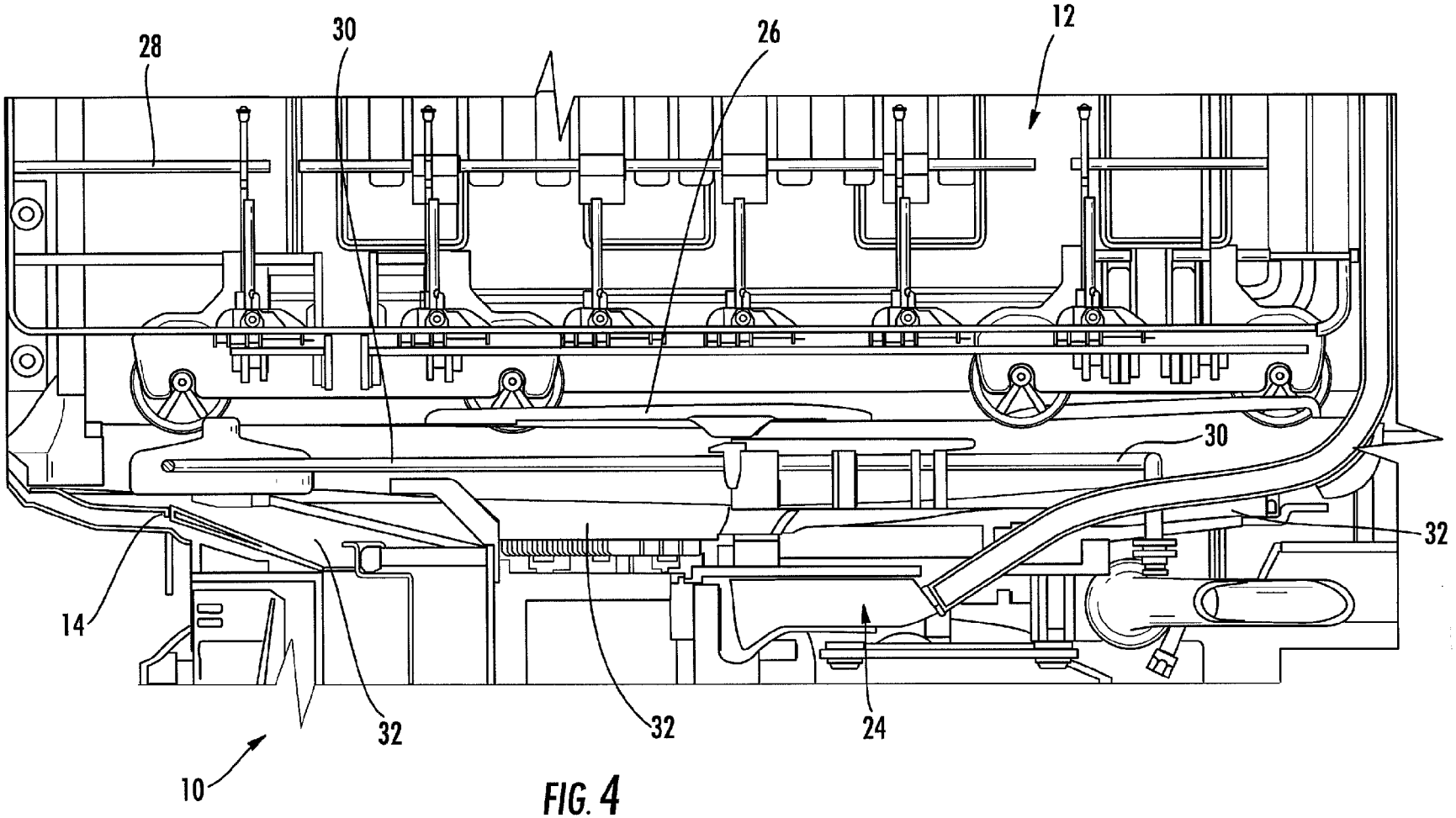
FIG. 4 is a vertical cross-sectional view of the dishwasher of FIG. 3, according to one embodiment of the present disclosure.

With continuing reference to FIGS. 1 and 2, in one embodiment, the filter 32 has a generally annular configuration, with a generally circular outer edge and a generally circular inner edge. The filter 32 is mounted to be substantially concentric with the loop of the heating element 30, wherein, in some instances, an outer diameter of the filter 32 is greater than that of the heating element loop, and an inner diameter of the filter 32 is less than that of the heating element loop. However, other configurations are possible, and aspects of the invention are not limited to any particular configuration. For example, as shown in FIGS. 3 and 4, the filter 32 may extend radially inward from the generally circular outer edge thereof so as to substantially cover the central portion of the bottom wall 14 of the tub 12.

Figure 5:
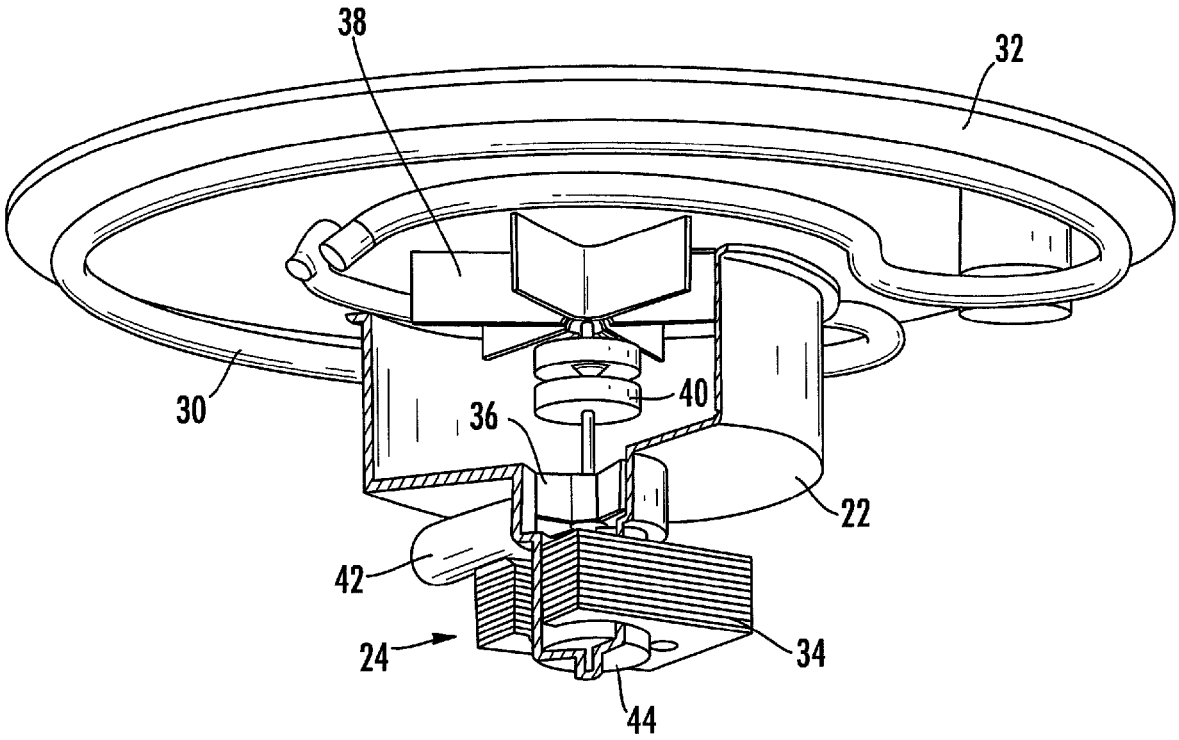
FIG. 5 is a cross-sectional view of a dishwasher in accordance with another embodiment of the invention, wherein a screen element is disposed above a heating element for protecting a lower spray arm of the dishwasher from heat emitted by the heating element.

In other embodiments of the present invention, as shown in FIG. 5, a partial assembly for the dishwasher 10 may include the sump 22 having an impeller 36 of the pump 24 housed therein. The impeller 36 may be mounted on a shaft of a pump motor 34 and driven by the motor 34 for pumping water from the sump 22 to the lower spray arm 26 FIGS. 1-4) and other spray arms of the dishwasher. A drain port 42 may be connected to the sump 22 for draining water and/or dishwashing fluid therefrom. In some instances, the motor 34 may have a "wet" rotor 44 disposed within the sump 22. Also mounted in the sump 22 above the impeller 36 may be an air circulation fan 38 for blowing hot air throughout the interior of the tub 12, during a drying cycle, when the dishwasher is in operation. A floating clutch 40 may be coupled between the impeller 36 and the air circulation fan 38 and is operable to decouple the air circulation fan 38 from the shaft of the impeller 36 when water is being pumped, or to couple the air circulation fan 38 to the impeller shaft 36 when air is being circulated. In such instances, the air circulated by the fan 38 is heated by the heating element 30, which, in this embodiment, is mounted beneath the filter 32. The heating element 30 also may heat the water being circulated by the pump 24, either by being submerged in the water or by contacting the water spray emitted from the spray arms.

The filter 32 may be disposed between the heating element 30 and the lower spray arm (not shown in FIG. 5). In such an embodiment, the filter 32 may be sized and positioned to protect/shield the lower spray arm from the heating element 30. The filter 32 may be in contact with the upper surface of the heating element 30 if desired, and thus may provide enhanced structural rigidity to the heating element 30 to prevent it from warping. Consequently, it may be possible to reduce the cross-sectional size of the heating element rod, which may allow further reduction in the total vertical space occupied by the heating element 30. There may also be clearance between the lower surface of the heating element 30 and the bottom wall 14 of the tub 12 so as to allow food soils to flow under the heating element 30 without being trapped. Accordingly, the "under-filter" heating element 30 may have a smaller "footprint" than that of the "over-filter" heating element of the embodiments of FIGS. 1-4.

Thus, embodiments of the present invention provide a screening element/filter 32 for separating food particles and soils from the water used in the dishwasher. The food soils are carried by the water toward the center of the filter 32 to a containment area in the sump 22 for holding the food soils until the dishwasher 10 goes into a drain cycle, during which the contained food soils are flushed out the drain. The filter 32 also functions to protect the lower end/bottom wall 14, the sump 22, the sump components, and/or the lower spray arm 26 from heat emitted by the heating element 30.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A screening arrangement adapted for a dishwasher, the dishwasher having a tub portion defining a sump about a lower end thereof and including a lower spray arm mounted adjacent to and above the lower end of the tub portion, the dishwasher further including a heating element disposed proximate to the lower end of the tub portion and defining radially opposed inner and outer peripheries, the screening arrangement comprising:

a filter member arranged below the heating element and configured to screen dishwashing fluid entering the sump from the tub portion, the filter member extending radially inward of the inner periphery of the heating element and radially outward of the outer periphery of the heating element, the filter member being configured to withstand, without at least one of melting or deforming, heat emitted by the heating element regardless of a distance between the heating element and the filter member, and the filter member being heat-resistant and configured to protect the lower end of the tub portion and the sump from heat emitted by the heating element.

2. A screening arrangement according to claim 1, wherein the filter member comprises at least one of a heat-insulating material, a heat-reflecting material, a heat-absorbing material, and a heat-dissipating material.

3. A screening arrangement according to claim 1, wherein the filter member has a first surface disposed toward the heating element, the first surface comprising at least one of a heat-insulating material, a heat-reflecting material, a heat-absorbing material, and a heat-dissipating material.

4. A screening arrangement according to claim 1, wherein the filter member comprises a metallic material, a composite material, a ceramic material, a polymer material, or combinations thereof, and the filter member further comprising a reflective coating.

5. A screening arrangement according to claim 4, wherein the filter member comprises a stainless steel.

6. A screening arrangement according to claim 1, wherein the heating element is formed in a loop having a radially outer periphery and a radially inner periphery, and wherein the filter member is configured to extend radially outward of the outer periphery and radially inward of the inner periphery of the heating element.

7. A screening arrangement according to claim 1, wherein the filter member is configured to prevent heat emitted from the heating element from being transmitted to the lower end of the tub portion and the sump.

8. A dishwasher, comprising:

a tub portion defining a sump about a lower end thereof;

a lower spray arm mounted adjacent to and above the lower end of the tub portion;

a heating element disposed proximate to the lower end of the tub portion and defining radially opposed inner and outer peripheries; and a filter member arranged below the heating element and configured to screen dishwashing fluid entering the sump from the tub portion, the filter member extending radially inward of the inner periphery of the heating element and radially outward of the outer periphery of the heating element, the filter member being configured to withstand, without at least one of melting or deforming, heat emitted by the heating element regardless of a distance between the heating element and the filter member, and the filter member being heat-resistant and configured to protect the lower end of the tub portion and the sump from heat emitted by the heating element.

9. A dishwasher according to claim 8, wherein the filter member comprises at least one of a heat-insulating material, a heat-reflecting material, a heat-absorbing material, and a heat-dissipating material.

10. A dishwasher according to claim 8, wherein the filter member has a first surface disposed toward the heating element, the first surface comprising at least one of a heat-insulating material, a heat-reflecting material, a heat-absorbing material, and a heat-dissipating material.

11. A dishwasher according to claim 8, wherein the filter member comprises a metallic material, a composite material, a ceramic material, a polymer material, or combinations thereof, and the filter member further comprising a reflective coating.

12. A dishwasher according to claim 8, wherein the filter member comprises a metallic material capable of shielding the lower end of the tub portion from heat radiated by the heating element.

13. A dishwasher according to claim 12, wherein the filter member comprises a stainless steel.

14. A dishwasher according to claim 8, wherein the heating element is formed in a loop having a radially outer periphery and a radially inner periphery, and wherein the filter member is configured to extend radially outward of the outer periphery and radially inward of the inner periphery of the heating element.

15. A dishwasher according to claim 8, wherein the filter member is configured to prevent heat emitted from the heating element from being transmitted to the lower end of the tub portion and the sump.

16. A method for protecting components of a dishwasher from heat emitted by a heating element associated therewith, the dishwasher having a tub portion defining a sump about a lower end thereof and including a lower spray arm mounted adjacent to and above the lower end of the tub portion, the heating element being disposed proximate to the lower end of the tub portion and defining radially opposed inner and outer peripheries, the method comprising:

operably engaging a filter member about a lower end of the tub portion below the heating element, the filter member being configured to screen dishwashing fluid entering the sump from the tub portion and to be heat-resistant, such that the filter member extends radially inward of the inner periphery of the heating element and radially outward of the outer periphery of the heating element, wherein the filter member is configured to withstand, without at least one of melting or deforming, heat emitted by the heating element regardless of a distance between the heating element and the filter member, and wherein the filter member is heat-resistant and configured to protect the lower end of the tub portion and the sump from heat emitted by the heating element.

* * * * *